United States Patent [19]

Kataoka

[11] Patent Number: 4,724,413

[45] Date of Patent: Feb. 9, 1988

[54] LOW-NOISE TRANSFORMER

[75] Inventor: Michio Kataoka, Hyogo, Japan

[73] Assignee: Mitsubishi Denki Kabushiki Kaisha, Tokyo, Japan

[21] Appl. No.: 850,521

[22] Filed: Apr. 11, 1986

[30] Foreign Application Priority Data

May 9, 1985 [JP] Japan ..... 60-96698

[51] Int. Cl.[4] ..... H01F 15/00

[52] U.S. Cl. ..... 336/100; 181/202

[58] Field of Search ..... 336/100; 181/202, 208; 335/247; 310/51

[56] References Cited

U.S. PATENT DOCUMENTS

| | | | |
|---|---|---|---|
| 1,846,887 | 2/1932 | Matthews | 336/100 |
| 2,731,606 | 1/1956 | Stewart et al. | 336/100 X |
| 3,077,946 | 2/1963 | Wilkins | 336/100 X |
| 4,146,112 | 3/1979 | Usry | 336/100 X |

FOREIGN PATENT DOCUMENTS

| | | | |
|---|---|---|---|
| 16124 | 6/1966 | Japan | 336/100 |
| 50-161624 | 12/1975 | Japan . | |
| 51-149524 | 12/1976 | Japan . | |
| 26424 | 2/1977 | Japan | 336/100 |
| 41825 | 3/1977 | Japan | 336/100 |
| 53-10020 | 1/1978 | Japan . | |

*Primary Examiner*—Thomas J. Kozma

*Attorney, Agent, or Firm*—Bernard, Rothwell & Brown

[57] ABSTRACT

A low-noise transformer, particularly for the use as an output transformer of an inverter, comprising a sound-proof envelope surrounding at least one of the windings for absorbing or screening noise originating from vibration due to electromagnetic force.

3 Claims, 5 Drawing Figures

LOW-NOISE TRANSFORMER

BACKGROUND OF THE INVENTION

1. Field of the Invention

This invention relates to a low-noise transformer, and more particularly to an improvement for reducing noise originating from an output transformer of an inverter.

2. Description of the Prior Art

A known output transformer of an inverter, as exemplified in a book, "Design and Manufacture of Transformers" supervised by Hisao Kimura, pp. 182–185, Denki Shoin, Japan, is shown in FIG. 1 in which reference numerals 1 and 2 designate primary and secondary windings, respectively, of the transformer 5; 3, spacers arranged circumferentially and between the primary and secondary windings 1, 2 for fixedly-supporting them; and 4, an iron core of the transformer 5.

FIG. 2 illustrates the circuitry of the transformer 5 shown in FIG. 1, and FIG. 3 is a circuit diagram illustrating the interconnection between the transformer 5 and an inverter. In FIG. 3, reference numerals 10 and 11 indicate an inverter connected to the primary winding of the transformer 5 and a load connected to the secondary winding, respectively.

The description of the action of the conventional transformer for use as an output transformer of an inverter is given below:

Referring to FIG. 3, assuming that an alternating current voltage $E_1(t)$ is applied to the primary winding 1, then in the ideal case the magnetic flux, denoted by $\phi$, is expressed as $$\phi = \frac{1}{n_1} \int E_1(t)\, dt$$

where $n_1$ is the numbers of turns for the primary winding.

If all the magnetic flux $\phi$ intersects with the secondary winding, then the voltage $E_2$ established at secondary winding 2 is given by $$E_2 = n_2 \frac{d\phi}{dt} = \frac{n_2}{n_1} E_1(t)$$

where $n_2$ is the number of turns for the secondary winding.

The output voltage of the inverter 10 includes many harmonic voltage components in respect to the fundamental frequency voltage. In this state, the harmonic voltage components induce electric current in the primary and secondary windings when the interconnection between transformer 5 and load 11 is completed.

The above-described prior art transformer for use as an output transformer of inverter, having the construction shown in FIG. 1, is disadvantageous in that it can not operate without considerable noise due to harmonic voltage component of the inverter.

SUMMARY OF THE INVENTION

It is the principal object of the invention to provide a useful low-noise transformer free from the above-mentioned drawbacks encountered in the prior art.

Another object of the invention is to provide a low-noise transformer, in particular with a reduced level of noise due to harmonic voltage components included in the output voltage of a inverter.

The usual sources of noise associated with transformers are as follows:

(a) Vibration of winding conductors (b) Vibration due to electromagnetic force between the windings (c) Vibration due to magnetic force between iron core elements forming joints and between the laminas, and (d) Vibration due to distortion of silicon steel plates.

On the basis of the fact that noise encountered in prior art transformers is probably due particularly to (b), the low-noise transformer according to the invention is designed to reduce noise by providing a sound-proof envelope surrounding at least one of the windings to absorb the vibration which is the cause of the noise, or to screen the noise.

Further objects and advantages of the invention will be more apparent from the following detailed description by way of an example with reference to the accompanying drawings:

PREFERRED EMBODIMENT OF THE INVENTION

Figure 1:
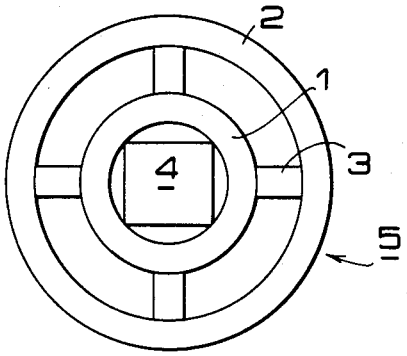
FIG. 1 (PRIOR ART)
FIG. 1 is a top view of a prior art transformer.
Figure 2:
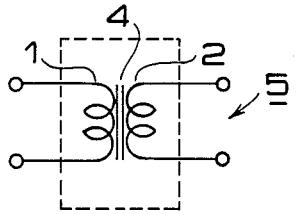
FIG. 2 (PRIOR ART)
FIG. 2 is the schematic diagram of the transformer of FIG. 1.
Figure 3:
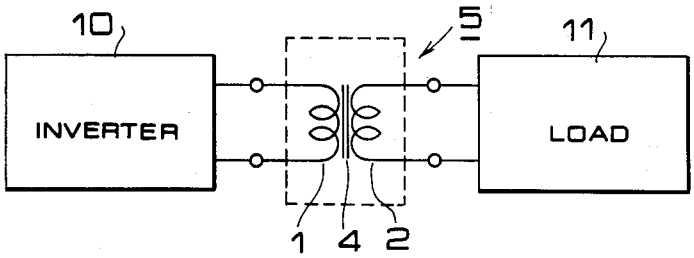
FIG. 3 (PRIOR ART)
FIG. 3 is a circuit diagram illustrating the interconnection between the primary winding of the transformer of FIG. 1 and an inverter and between the secondary winding and a load.

In the following, an embodiment of the invention will be described in detail with reference to FIGS. 4 and 5, in which the same reference numerals as assigned in FIG. 1 designate parts or components corresponding to those in FIG. 1.

Figure 4:
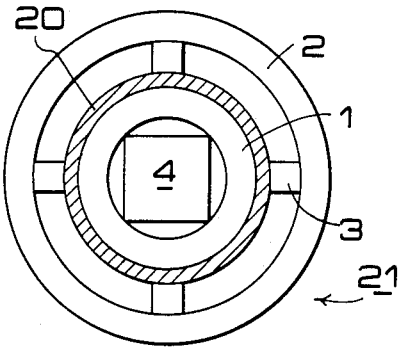
FIG. 4 is a view, partly in section, showing a low-noise transformer of one embodiment according to this invention.

FIG. 4 illustrates an embodiment of a low-noise transformer 21 according to the invention which is so constructed that the primary winding is shielded with a sound-proof envelope 20 surrounding it. The sound-proof envelope 20 is made of sound-absorbing material such as silicon rubber or sound-reflecting material such as metallic coil.

Figure 5:
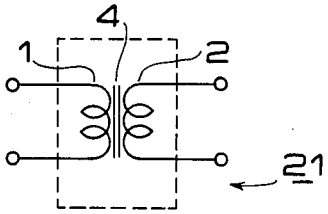
FIG. 5 is a circuit diagram of FIG. 4.

The transformer 21 embodying the invention has the circuitry shown in FIG. 5.

When the thus-constructed transformer 21 is connected on the side of the primary winding to an inverter and on the side of the secondary winding to a load, the primary winding 1 is fed with a harmonic voltage included in the output voltage of the inverter, and accordingly harmonic current flows through the primary winding 1 to cause vibration of the primary winding 1. By virtue of the above-described construction, however, noise due to the vibration is absorbed by or screened by the sound-proof envelope 20, to reduce noise transmitted externally.

There may be provided such a sound-proof envelope 20 surrounding the secondary winding instead of the primary winding in the above embodiment.

Besides there may be provided such a sound-proof envelope 20 likewise for a transformer with an outer primary winding 1 and an inner secondary winding 2 in respect to the iron core.

As described above, according to the invention, there is provided a sound-proof envelope surrounding at least one winding which is a major vibration source, and thereby noise caused by its vibration is absorbed or screened to reduce noise transmitted externally. By this invention there is provided at low cost a low-noise transformer which minimizes noise leaking outside.

What is claimed is:

1. A low-noise transformer, particularly for use as an output transformer of an inverter, comprising an iron core, an inner primary winding having terminals for connection to an inverter and an outer secondary winding having terminals for connection to a load, said windings being wound around said iron core, spacers disposed between said primary and secondary windings for fixedly supporting said windings, and a sound-proof envelope surrounding only said primary winding.

2. A low-noise transformer defined in claim 1 wherein said sound-proof envelope is made of a sound-absorbing material.

3. A low-noise transformer defined in claim 1 wherein said sound-proof envelope is made of a sound-reflecting material.

* * * * *